United States Patent [19]

Papay et al.

[11] 4,204,969

[45] May 27, 1980

[54] LUBRICANT COMPOSITION CONTAINING SULFURIZED OLEFIN EXTREME PRESSURE ADDITIVE

[75] Inventors: Andrew G. Papay, Manchester; Joseph P. O'Brien, Kirkwood, both of Mo.

[73] Assignee: Edwin Cooper, Inc., St. Louis, Mo.

[21] Appl. No.: 950,022

[22] Filed: Oct. 10, 1978

[51] Int. Cl.[2] ..... C10M 1/38

[52] U.S. Cl. ..... 252/45; 260/139

[58] Field of Search ..... 252/45; 260/139

[56] References Cited

U.S. PATENT DOCUMENTS

| | | | |
|---|---|---|---|
| 2,291,404 | 7/1942 | Morway | 252/45 X |
| 2,790,833 | 4/1957 | Liao | 252/45 X |
| 3,471,404 | 10/1969 | Myers | 252/45 |
| 3,481,871 | 12/1969 | Myers et al. | 252/45 |
| 3,873,454 | 3/1975 | Horodysky et al. | 252/45 X |
| 3,925,414 | 12/1975 | Landis et al. | 252/45 X |

FOREIGN PATENT DOCUMENTS

| | | | |
|---|---|---|---|
| 556921 | 5/1958 | Canada | 252/45 |

*Primary Examiner*—Andrew Metz

*Attorney, Agent, or Firm*—Donald L. Johnson; Robert A. Linn; Joseph D. Odenweller

[57] ABSTRACT

An additive for improving extreme pressure properties of lubricating oil is made by reacting sulfur monochloride with a monoolefin (e.g. isobutene) in the presence of a promoter amount of a lower alkanol (e.g. methanol) to form an adduct, reacting the adduct with sulfur and sodium sulfide in an aqueous alkanol made at a ratio of 0.1–0.4 gram atom of sulfur per gram mole of sodium sulfide and then recovering the reaction product.

11 Claims, No Drawings

LUBRICANT COMPOSITION CONTAINING SULFURIZED OLEFIN EXTREME PRESSURE ADDITIVE

BACKGROUND OF THE INVENTION

Sulfurized olefins are well-known additives in lubricating oil, cutting oil and the like. Kimball, U.S. Pat. No. 2,249,312, describes such a product. Eby, U.S. Pat. No. 2,708,199, describes a similar product in which a sulfur halide is reacted with an olefin using a lower alkanol promoter to obtain an intermediate which is reacted with an alkali or alkaline earth metal polysulfide. Myers, U.S. Pat. No. 3,471,404, describes a product in which sulfur monochloride is reacted with olefin to obtain an intermediate which is reacted with sulfur and alkali metal sulfide at a critical ratio of 1.8–2.2 gram moles of metal sulfide per gram mole of sulfur. This material is then refluxed for 1–24 hours with aqueous alkali metal hydroxide.

SUMMARY OF THE INVENTION

According to the present invention an improved sulfurized olefin additive for lubricating oil is obtained by reacting sulfur monochloride with aliphatic monoolefin to form an adduct which is reacted with sulfur and sodium sulfide and then recovered by conventional methods without further treatment with aqueous caustic.

DESCRIPTION OF THE PREFERRED EMBODIMENTS

A preferred embodiment of this invention is a sulfurized lubricating oil additive which imparts improved extreme pressure properties made by the process consisting essentially of (a) reacting $S_2Cl_2$ with a $C_{3-6}$ aliphatic monoolefin at about 30–100° C. to produce an adduct, (b) reacting said adduct with sulfur and $Na_2S$ in an aqueous alkanol medium at a temperature of about 50° C. up to reflux using about 0.1–0.4 gram atom of sulfur per gram mole of $Na_2S$ and then (3) recovering said additive.

Useful olefins are the monoethylenically unsaturated aliphatic hydrocarbons referred to as aliphatic monoolefin containing 3 to about 6 carbon atoms. These include 1-butene, 2-butene, isobutene, 1-pentene, 2-pentene, 2-methyl-1-butene, 3-methyl-1-butene, 2-methyl-2-butene, 1-hexene, 2-hexene, 3-hexene, 2-methyl-1-pentene, 2-methyl-2-pentene, 2-ethyl-2-butene and the like including mixtures thereof.

Preferably the olefins are branched-chain olefin such as isobutene, 2-methyl-1-butene, 2-methyl-2-butene, 2-methyl-2-pentene and the like. More preferably the ethylenic double bond adjoins a tertiary carbon atom such as isobutylene, the most preferred olefin.

The first stage reaction is preferably conducted by adding the olefin to the sulfur monochloride. The olefin can be added as a gas or liquid. Preferably it is added beneath the surface of the sulfur monochloride as a liquid.

In practice the olefin is added until the reaction with the sulfur monochloride stops as indicated by loss of exotherm. An amount of about 0.75–2.0 gram moles of olefin for each 0.3–0.75 gram mole of sulfur monochloride usually suffices. A preferred amount is about 1.8–2.2 gram moles of olefin per gram mole of sulfur monochloride.

The reaction between sulfur monochloride and olefin will proceed without adding an alkanol promoter, but the use of an alkanol promoter is highly preferred. In the present process use of such a promoter gives products having significantly better EP (extreme pressure) properties.

The lower alkanol promoter used in the first stage contains from about 1 to about 4 carbon atoms such as methanol, ethanol, n-propanol, isopropanol, isobutanol, tert-butanol and the like. The most preferred promoter is methanol.

The lower alkanol promoter can be added to the sulfur monochloride initially, added to the reaction mixture continuously or periodically during the course of the olefin addition or the alkanol can be mixed with the olefin and added together with the olefin. The preferred modes of addition are to either add the entire amount initially and then add the olefin or to concurrently add both alkanol and olefin.

The amount of alkanol promoter is preferably about 0.001 to about 0.3 gram moles for each 0.3–0.75 gram mole of sulfur monochloride.

The first stage reaction can be conducted at any temperature high enough to cause the reaction to proceed, but not so high as to cause decomposition of the reactants or products. A useful range is about 30°–100° C. A more preferred range is about 40°–75° C. and a most preferred range is about 50°–60° C.

The first stage reaction should be conducted for a time sufficient to complete the reaction between sulfur monochloride and olefin. This is usually limited by heat removal. Olefin feed rate is preferably controlled to hold the temperature within the desired range. When the sulfur monochloride has been consumed the temperature will drop. External heat may be added to continue the reaction for a further time, but this does not appear to be necessary. The overall time required to complete the reaction depends upon the scale of the process and can vary from a few minutes up to 12 or more hours. The time is not critical.

During the first stage reaction HCl gas is evolved so means should be provided to scrub the vent gas from the reactor to remove HCl prior to releasing it to the atmosphere.

In the second stage reaction, adduct from the first stage is reacted with sodium sulfide and sulfur in an aqueous alkanol reaction medium. The second stage is preferably carried out by charging aqueous sodium sulfide, water, alkanol and elemental sulfur flowers to a reactor and then adding the adduct to this at reaction temperature.

The sodium sulfide may be obtained from any of a number of sources. For example, it can be made by mixing approximately equal mole amounts of sodium hydrosulfide and sodium hydroxide. If hydrogen sulfide is available, it can be adsorbed in aqueous NaOH to form a solution of sodium sulfide and/or sodium hydrosulfide depending upon the amount of hydrogen sulfide adsorbed. Whatever the source, the resulting solution should be adjusted with either NaOH, NaSH or $H_2S$ so that the resulting solution consists mainly of sodium sulfide with little or no free sodium hydroxide.

The amount of sodium sulfide can vary somewhat. For example, from about 0.45–0.7 gram mole for each 0.3–0.75 gram mole of sulfur monochloride used in the first reaction stage. Preferably the amount of sodium sulfide is about 0.7–2 gram mole per mole of sulfur monochloride and most preferably about 0.8–1 gram mole per gram mole sulfur monochloride.

The amount of water can vary widely without detrimental effect. Good results can be obtained using about 10–20 gram moles of water per gram mole of sodium sulfide. This includes water added as such, water in aqueous reactants and water which might be formed by reaction of hydrogen sulfide or sodium hydrosulfide with sodium hydroxide in forming sodium sulfide solution.

Alcohol is required in the second stage reaction. Preferably, these are lower alkanols containing 1–4 carbon atoms such as methanol, ethanol, n-propanol, n-butanol, isobutanol, tert-butanol and the like, including mixtures thereof. The preferred alkanol is isopropanol either alone or mixed with other alkanols such as tert-butanol.

The amount of alkanol can likewise vary over a wide range. A useful range is about 0.1–0.5 parts by weight per each part by weight of water. A more preferred range is about 0.2–0.4 parts by weight alkanol per each part by weight water.

The preferred amount of sulfur added is 0.05–0.18 gram atom for each 0.45–0.7 gram mole of sodium sulfide. More preferably, about 0.1–0.25 gram atom of sulfur are used per gram mole of sodium sulfide.

In a preferred mode of operation the mixture of sodium sulfide, sulfur and aqueous alkanol is stirred and heated to reaction temperature and then the adduct is added to it. However, the reaction can be carried out in other ways such as by adding the sodium sulfide, sulfur and aqueous alkanol mixture to the adduct or by mixing everything together and heating the mixture.

Preferred second stage reaction temperature is about 50° C. up to reflux temperature. A more preferred reaction temperature is about 60–80° C.

After the adduct has been added to the sodium sulfide/sulfur/aqueous alkanol mixture, which is usually completed in about 1–8 hours, the mixture is preferably heated to reflux for about 2–8 hours to assure completion of the reaction.

An essential feature of the new sulfurized product is that when made according to the foregoing disclosure, there is no need for further caustic treatment in order to obtain a useful EP additive. Accordingly, the present invention does not contemplate a product which is subsequently heated with aqueous caustic solution such as disclosed in Myers, U.S. Pat. No. 3,471,404.

After reaction of the adduct with sodium sulfide and sulfur the product is recovered by conventional method such as removing alkanol, water washing and filtering.

The following example illustrates the manner of making the sulfurized olefin.

EXAMPLE

In a reaction vessel place 77.7 grams of sulfur monochloride and 0.31 gram of methanol. While stirring start adding liquid isobutylene below the surface to bring the temperature up to 55° C. Continue adding isobutylene at this temperature until the exothermic reaction stops. This requires 28–32 grams of isobutylene.

In a second reaction vessel mix 90 grams of 32.1 wt % aqueous sodium hydrosulfide and 41.3 grams of 50 wt % aqueous sodium hydroxide. To this add 44.4 grams of isopropanol and 2.9 grams of sulfur flowers. Stir for 5 minutes and then add 55.1 grams of water and heat the mixture to 75° C. Over a 2-hour period add the first stage adduct to this mixture while stirring at about 75° C. Following this heat the mixture to reflux for 4 hours to complete the reaction.

Distill out ispropanol up to 90° C. and then reduce pressure to complete removal of alcohol and most of the water. Wash the product with 68 grams of water to remove salt and separate off the aqueous layer. Wash the organic phase a second time with a mixture of 68 grams of water and 34 grams of hexane. While stirring heat this mixture to reflux and then cool and allow to separate. Remove and discard the aqueous phase and distill hexane from the organic phase. Filter the resultant material to obtain a sulfurized olefin (48 wt % sulfur) which is a very effective EP additive in lubricating oil.

The sulfurized olefins are especially useful in lubricating oil formulations used in gear applications. The base oil may be a mineral oil or a synthetic oil. Useful synthetic oils include olefin oligomers such as decene trimer, tetramer and pentamer made by oligomerizing 1-decene using a $BF_3$ catalyst. Useful olefin oligomers can be made using other catalysts such as the aluminum alkyl Ziegler catalyst. Likewise, other olefins can be used such as $C_{6-14}$ 1-olefins.

Synthetic alkylbenzenes can also be used such as di-dodecylbenzene and the like.

Synthetic ester lubricating oil can also be employed such as the alkyl esters of dicarboxylic acid (e.g. di-2-ethylhexylsebacate), fatty acid esters of polyols (e.g. trimethylolpropane, tripelargonate) or complex esters of alkanols, alkane, polyols and carboxylic or polycarboxylic acid.

In this use the sulfurized olefin is added in an amount sufficient to improve the EP property of the lubricant. An amount of 0.1 to 10.0 wt % is usually sufficient.

Fully formulated gear lubricants include other conventional additives which perform various functions. Examples of such other additives are corrosion inhibitors for ferrous and non-ferrous metals such as tetrapropenyl succinic acid and bis-(2,5-alkyldithia)-1,3,4-thiadiazoles. Antiwear additives such as alkyl or aryl phosphonates, phosphite, thiophosphates, dithiophosphates, and phosphoric acids. Also zinc dialkyl or diaryl dithiophosphate, chlorinated hydrocarbons, sulfurized fatty esters and amines.

Tests have been conducted which demonstrate the EP effectiveness of the sulfurized olefin. In these tests a product of this invention made essentially as in the example was compared to the product made according to Myers, U.S. Pat. No. 3,471,404. The two products analyzed as follows:

| | % S | Visc CS at 100° F. |
|---|---|---|
| Present additive | 49 | 8.6 |
| U.S. 3,471,404 | 45.5 | 10.8 |

The tests were conducted in SAE 90 mineral oil. The first was a 4-ball weld test (ASTM D2783) in which a steel ball is rotated in loaded contact with three fixed balls. The maximum load without weld is recorded as the pass load.

A second test conducted was the SAE Load Test in which 2 steel rings are rotated under loaded contact such that there is metal slide at the contact point. The maximum load prior to metal seizure is determined.

The results of these tests were as follows:

| Four-Ball Test | | | |
|---|---|---|---|
| | | Load (Kg) | |
| Additive | Conc (wt. %) | Pass | Fail |
| U.S. 3,471,404 | 1.3 | 220 | 240 |
| " | 1.4[3] | 240 | 260 |
| Present additive | 1.3 | 280 | — |

| SAE Load Test | | |
|---|---|---|
| Additive | Conc. (wt. %) | Load[1] (lbs) |
| U.S. 3,471,404 | 3.5 | 400 |
| " | 3.77[3] | 413 |
| Present additive | 3.5 | 600[2] |

[1]Six run average.
[2]Maximum load.
[3]Conc to give same sulfur concentration.

These results demonstrate the unusual effectiveness of the present additive.

We claim:

1. A sulfurized lubricating oil additive which imparts improved extreme pressure properties made by the process consisting essentially of (a) reacting $S_2Cl_2$ with a $C_{3-6}$ aliphatic monoolefin at about 30°–100° C. to produce an adduct, (b) reacting said adduct with sulfur and $Na_2S$ in an aqueous alkanol medium at a temperature of about 50° C. up to reflux using about 0.1–0.4 gm atom of sulfur per gm mole of $Na_2S$ and then (c) recovering said additive without heating with aqueous caustic.

2. A sulfurized additive of claim 1 wherein said monoolefin is a branched chain monoolefin.

3. A sulfurized additive of claim 2 wherein said olefin is isobutene.

4. A sulfurized additive of claim 1 wherein step (a) is conducted in the presence of a promoter amount of a lower alkanol.

5. A sulfurized additive of claim 4 wherein said monoolefin is isobutene.

6. A sulfurized additive of claim 5 wherein the ratio of sulfur to $Na_2S$ is about 0.15–0.2 gm atom of sulfur per mole of $Na_2S$.

7. A sulfurized additive of claim 5 wherein said lower alkanol promoter is methanol.

8. A sulfurized additive of claim 7 wherein said promoter amount is about 0.01–0.05 gm mole of methanol per mole of $S_2Cl_2$.

9. A sulfurized additive of claim 8 wherein the ratio of sulfur to $Na_2S$ is about 0.01–0.05 gm atom of sulfur per gm mole of $Na_2S$.

10. A sulfurized lubricating oil additive made by the process consisting essentially of (a) reacting about 0.75–2 gm moles of $C_{3-6}$ aliphatic monoolefin with about 0.3–0.75 gm mole of $S_2Cl_2$ and 0.001–0.05 gm moles of methanol at a temperature of about 30°–100° C. to form an adduct, (b) reacting said adduct with about 0.45–0.7 gm mole of $Na_2S$ and about 0.05–0.18 gm atom of sulfur in an aqueous lower alkanol medium at a temperature of about 50° C. up to reflux and (c) recovering said sulfurized additive without heating with aqueous caustic.

11. A lubricating oil composition containing an extreme pressure improving amount of a sulfurized oil additive of claim 1.

* * * * *

UNITED STATES PATENT AND TRADEMARK OFFICE

CERTIFICATE OF CORRECTION

PATENT NO. : 4,204,969

DATED : MAY 27, 1980

INVENTOR(S) : ANDREW G. PAPAY ET AL

It is certified that error appears in the above-identified patent and that said Letters Patent are hereby corrected as shown below:

Claim 9 - Column 6, line 17 - delete "0.01-0.05"

and insert -- 0.1-0.25 --

Signed and Sealed this

*Twenty-eighth* Day of *October 1980*

[SEAL]

*Attest:*

SIDNEY A. DIAMOND

*Attesting Officer*

*Commissioner of Patents and Trademarks*